US006068558A

United States Patent [19]

Gill et al.

[11] Patent Number: 6,068,558

[45] Date of Patent: May 30, 2000

[54] HEXAGONAL BILLIARD-TYPE GAME

[76] Inventors: Colin Gill; Mark Howard; Gary Wood, all of 9 Brierley Avenue, Edmonton, London N9 8PR, United Kingdom

[21] Appl. No.: 09/141,924

[22] Filed: Aug. 28, 1998

[51] Int. Cl.[7] ..... A63D 15/00

[52] U.S. Cl. ..... 473/18; 473/20; 473/40

[58] Field of Search ..... 473/18, 20, 40, 473/4, 28; 273/123 R, 118 R, 261, 244, 277, 283, 284, 108.1; D21/782, 783, 316, 363, 342, 385

[56] References Cited

U.S. PATENT DOCUMENTS

| | | |
|---|---|---|
| D. 86,218 | 2/1932 | Cannon . |
| 157,737 | 2/1874 | Cook . |
| D. 218,106 | 7/1970 | O'Leary . |
| 928,160 | 7/1909 | Snedaker . |
| 1,092,006 | 3/1914 | Bailey . |
| 1,186,878 | 6/1916 | Brown . |
| 1,391,909 | 9/1921 | McCool . |
| 1,625,265 | 4/1927 | Malloy . |
| 3,522,778 | 8/1970 | Porath . |
| 4,294,449 | 10/1981 | Shaw . |
| 4,452,450 | 6/1984 | Cayton . |
| 5,800,273 | 9/1998 | Potocki . |

FOREIGN PATENT DOCUMENTS

| | | | |
|---|---|---|---|
| 2243759 | 3/1974 | Germany | 473/20 |

*Primary Examiner*—Sebastiano Passanti

[57] ABSTRACT

A billiard type game is provided including a table having a top plate with a hexagonal configuration and a vertically oriented pocket formed in each corner thereof. Also included is a plurality of balls, a pair of cue sticks and a rack with a hexagonal configuration.

9 Claims, 2 Drawing Sheets

HEXAGONAL BILLIARD-TYPE GAME

BACKGROUND OF THE INVENTION

1. Field of the Invention

The present invention relates to pool related games and more particularly pertains to a new hexagonal billiard-type game for providing entertainment.

2. Description of the Prior Art

The use of pool related games is known in the prior art. More specifically, pool related games heretofore devised and utilized are known to consist basically of familiar, expected and obvious structural configurations, notwithstanding the myriad of designs encompassed by the crowded prior art which have been developed for the fulfillment of countless objectives and requirements.

Known prior art pool related games include U.S. Pat. No. 4,768,781; U.S. Pat. No. 3,985,355; U.S. Pat. No. 2,262,610; U.S. Pat. No. 3,958,804; U.S. Pat. No. 4,474,374; and U.S. Pat. No. 3,466,038.

In these respects, the hexagonal billiard-type game according to the present invention substantially departs from the conventional concepts and designs of the prior art, and in so doing provides an apparatus primarily developed for the purpose of providing entertainment.

SUMMARY OF THE INVENTION

In view of the foregoing disadvantages inherent in the known types of pool related games now present in the prior art, the present invention provides a new hexagonal billiard-type game construction wherein the same can be utilized for providing entertainment.

The general purpose of the present invention, which will be described subsequently in greater detail, is to provide a new hexagonal billiard-type game apparatus and method which has many of the advantages of the pool related games mentioned heretofore and many novel features that result in a new hexagonal billiard-type game which is not anticipated, rendered obvious, suggested, or even implied by any of the prior art pool related games, either alone or in any combination thereof.

To attain this, the present invention generally comprises a table having a planar top plate having a top face, a bottom face and a periphery with a hexagonal configuration. The periphery of the top plate has a peripheral lip integrally coupled thereto and extending upwardly therefrom. A plurality of elastomeric bumpers are mounted on an interior surface of the peripheral lip. The table further includes a vertically oriented bore formed in each corner thereof. The table further includes a base with a hexagonal horizontal cross-section along a height thereof. The base is mounted to the bottom face of the top plate for supporting the same. A plurality of tubular nets each have a closed bottom. Further, each tubular net has an open top mounted to the bottom face of the top plate about an associated one of the bores. As shown in FIG. 1, the top face of the top plate of the table has a felt lining divided into a plurality of zones defined by three colors. The sections includes six triangular neutral zones each with a first color. A side edge of each triangular neutral zone is situated along one side of the peripheral lip of the table. A central hexagonal neutral zone is also included. Six player zones include three player zones having a second color and three player zones having a third color. The player zones each have a frusto-diamond shaped configuration and are further situated in an alternating fashion. FIG. 4 shows a plurality of balls of the present invention. The balls include twelve star balls including six star balls of the second color and six star balls of the third color. Also included are six user balls of a fourth color, a single cue ball, a single zone ball of a fifth color. A pair of cue sticks are provided. FIG. 4 also shows a rack with a hexagonal configuration. In use, the rack is adapted to be removably situated on a pair of horizontally oriented, parallel pegs mounted on a side face of the base of the table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hexagonal billiard-type game apparatus and method which has many of the advantages of the pool related games mentioned heretofore and many novel features that result in a new hexagonal billiard-type game which is not anticipated, rendered obvious, suggested, or even implied by any of the prior art pool related games, either alone or in any combination thereof.

It is another object of the present invention to provide a new hexagonal billiard-type game which may be easily and efficiently manufactured and marketed.

It is a further object of the present invention to provide a new hexagonal billiard-type game which is of a durable and reliable construction.

An even further object of the present invention is to provide a new hexagonal billiard-type game which is susceptible of a low cost of manufacture with regard to both materials and labor, and which accordingly is then susceptible of low prices of sale to the consuming public, thereby making such hexagonal billiard-type game economically available to the buying public.

Still yet another object of the present invention is to provide a new hexagonal billiard-type game which provides in the apparatuses and methods of the prior art some of the advantages thereof, while simultaneously overcoming some of the disadvantages normally associated therewith.

Still another object of the present invention is to provide a new hexagonal billiard-type game for providing entertainment.

Even still another object of the present invention is to provide a new hexagonal billiard-type game that includes a table having a top plate with a hexagonal configuration and a vertically oriented pocket formed in each corner thereof. Also included is a plurality of balls, a pair of cue sticks and a rack with a hexagonal configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
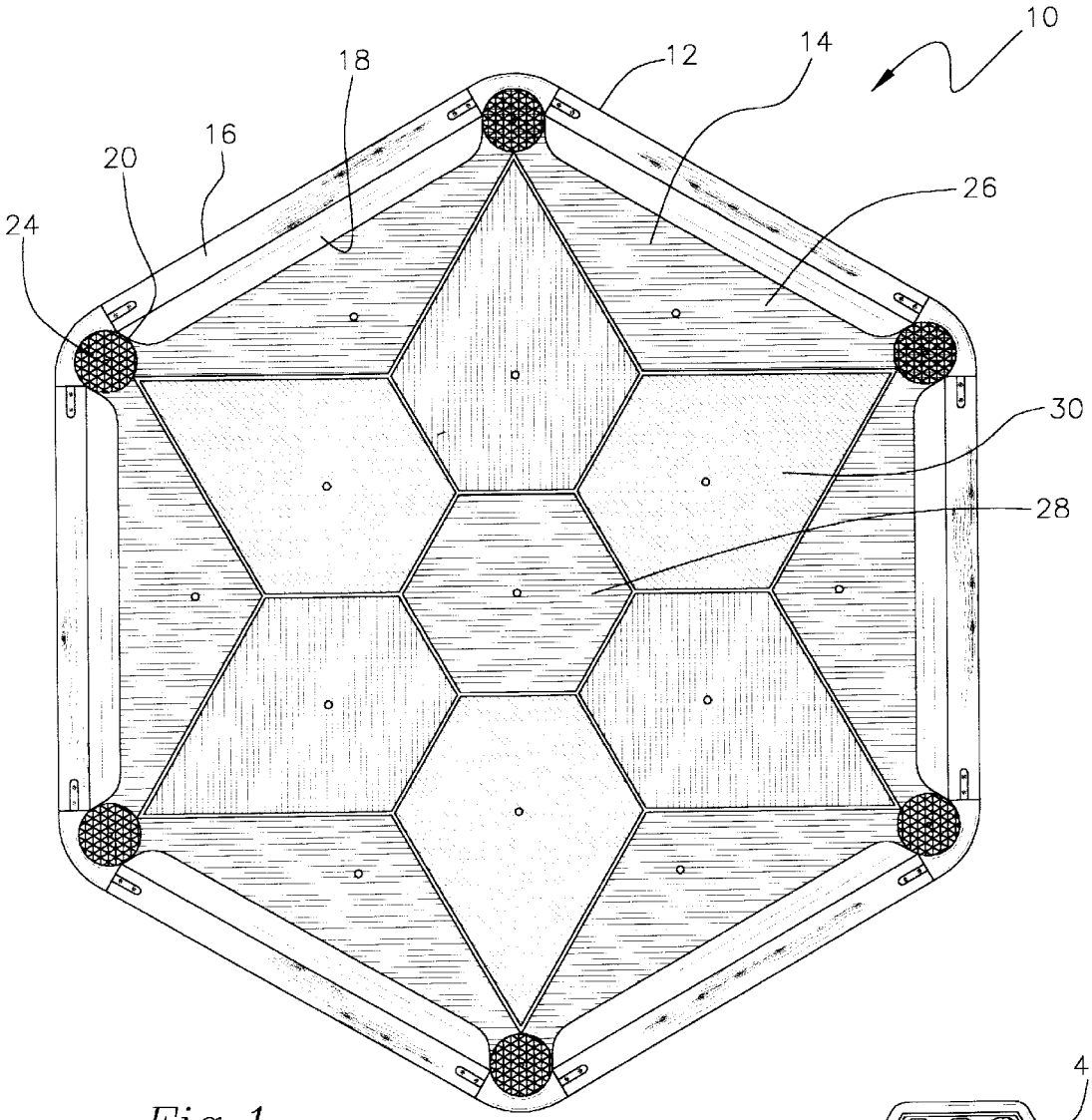
FIG. 1 is a top view of a new hexagonal billiard-type game according to the present invention.
Figure 2:
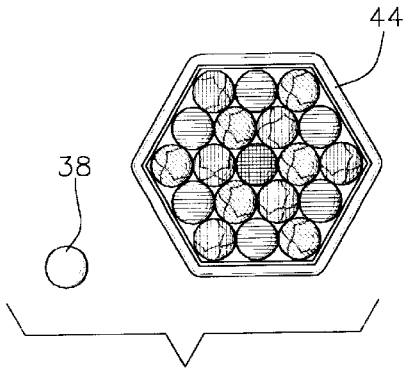
FIG. 2 is an exploded view of the rack and cue ball of the present invention.
Figure 3:
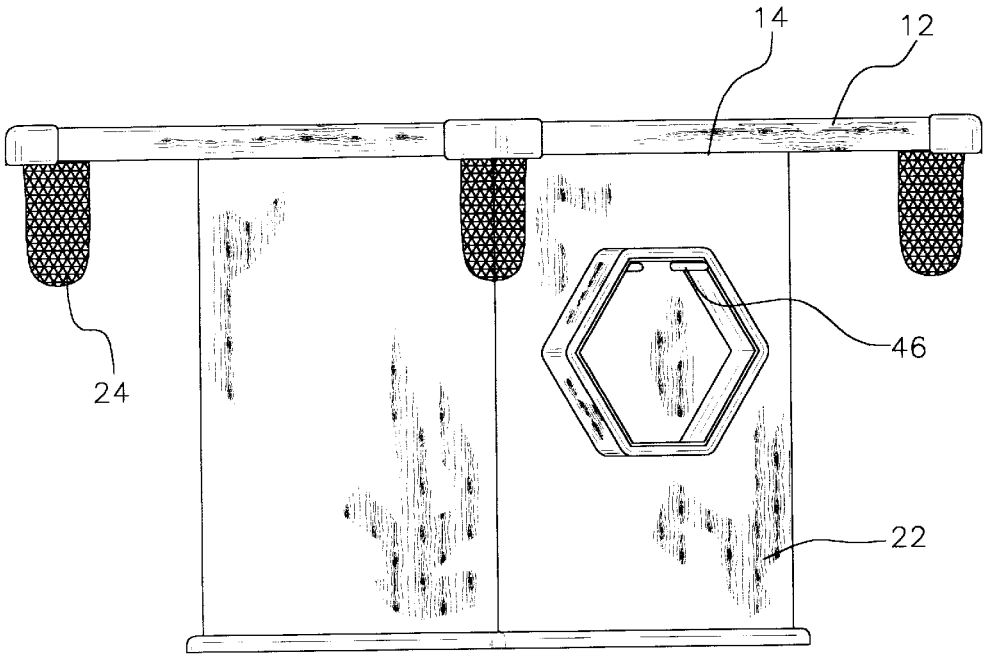
FIG. 3 is a side view of the table of the present invention.

With reference now to the drawings, and in particular to FIGS. 1 through 4 thereof, a new hexagonal billiard-type game embodying the principles and concepts of the present invention and generally designated by the reference numeral 10 will be described.

The present invention, designated as numeral 10, includes a table 12 having a planar top plate 14 with a top face, a bottom face and a periphery having a hexagonal configuration. The periphery of the top plate has a peripheral lip 16 integrally coupled thereto and extending upwardly therefrom. A plurality of elastomeric bumpers 18 are mounted on an interior surface of the peripheral lip. The table further includes a vertically oriented bore 20 formed in each corner thereof. Each bore is preferably recessed within the associated corner of the peripheral lip.

The table further includes a base 22 with a hexagonal horizontal cross-section along a height thereof. The base is mounted to the bottom face of the top plate for supporting the same. A plurality of tubular nets 24 each have a closed bottom. Further, each tubular net has an open top mounted to the bottom face of the top plate about an associated one of the bores.

As shown in FIG. 1, the top face of the top plate of the table has a felt lining 24 divided into a plurality of zones defined by three colors. The sections includes six triangular neutral zones 26 each with a first color, namely blue. A side edge of each triangular neutral zone is situated along one side of the peripheral lip of the table. A blue central hexagonal neutral zone 28 is also included. Six player zones 30 include three player zones having a second color, namely red, and three player zones having a third color, namely green. The player zones each have a frusto-diamond shaped configuration and are further situated in an alternating fashion. As shown in FIG. 1, a center of each zone is marked for reasons that will soon become apparent.

Figure 4:
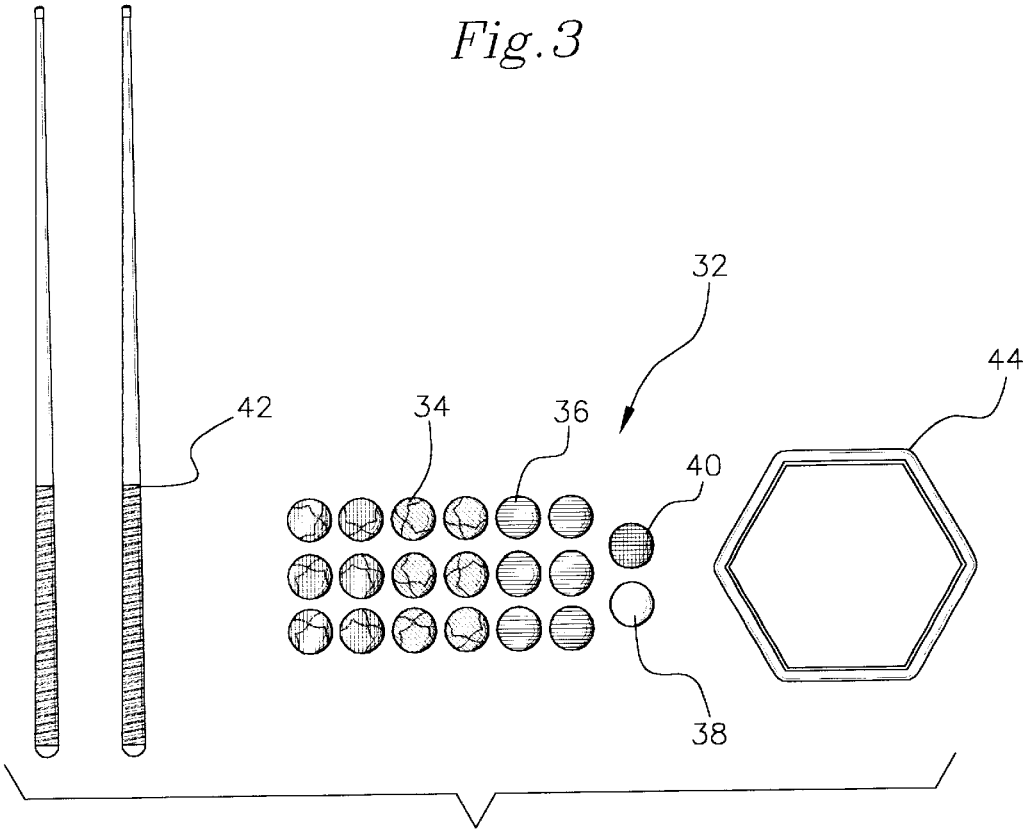
FIG. 4 is a top exploded view of the various components of the present invention.

FIG. 4 shows a plurality of balls 32 of the present invention. The balls include twelve star balls 34 comprising six star balls of the second color and six star balls of the third color. Also included are six user balls 36 of a fourth color, a single cue ball 38, and a single zone ball 40 of a fifth color. A pair of cue sticks 42 are provided.

FIG. 4 also shows a rack 44 with a hexagonal configuration. An interior periphery of the rack is preferably lined with padded felt. In use, the rack is adapted to be removably situated on a pair of horizontally oriented, parallel pegs 46 mounted on a side face of the base of the table when not in use.

The method associated with the present invention will now be set forth. It should be noted that the method set forth hereinbelow may be reproduced in an instruction pamphlet to accompany the foregoing components of the present invention.

THE RACK AND THE BALLS

THE RACKING ORDER

A perfectly balanced combination, a racking order, where there is no advantage for the player breaking off scattering the balls across the zones on the table, how many will rest inside their own zones?, how many won't?. No break will ever be the same twice and only the laws of the hexagonal table will dictate the content of the game ahead. There is a point in the rack that will pocket a ball nearly every time (if you can find it) but that may not suit all players of ZONEBALL. IT REALLY is UP TO THE PLAYER.

THE RACK CONSISTS OF:

1 ZONEBALL * 6 GREEN STARBALLS * 6 RED STARBALLS * 6 USERBALLS * 1 CUE BALL

THE CUE BALL (FOUL VALUE 6 POINTS

In Zoneball, the option to pocket Starballs with the cue ball will be limited or means scoring less points. The cue balls primary function is that of cannons, plants or maneuvering and positioning Starballs. Overall the cue ball is a considerably much weaker option than the Zoneball, but its importance during any game should never by under estimated.

THE ZONEBALL (VALUE 6 POINTS)

The ZONEBALL is the power ball, and to control it is the key to victory. When a player controls and uses the ZONEBALL it gives that player a choice of not one but two cue balls, and it permits the pocketing of off zone Starballs. In the games played for points, the Zoneball dramatically increases points values of on zone Starballs. The following game rules stipulate exactly what is permitted with the ZONEBALL. The ZONEBALL must be the last ball pocketed to end the frame.

1) A PLAYER IS PERMITTED TO SELECT THE ZONEBALL TO PLAY OWN STARBALLS OR USERBALLS WHEN THE ZONEBALL SITS WITHIN THE PLAYERS OWN COLOR ZONE.

2) A PLAYER IS PERMITTED TO SELECT THE ZONEBALL TO PLAY USERBALUS WHEN THE ZONEBALL RESTS IN THE BLUE ZONE.
3) DURING AN OPEN TABLE SITUATION, FOLLOWING THE BREAK, PLAYER'S MAY SELECT TO USE THE ZONEBALL FOR PLAYING ONLY BALLS CORRESPONDING WITH THE COLOR ZONE IN WHICH THE ZONEBALL 15 PRESENTLY SITTING IN.
4) THERE ARE ONLY TWO INSTANCES THAT A PLAYER CAN SELECT TO USE THE ZONEBALL FROM ANY ZONE ON THE TABLE, AND THIS IS, IF THAT PLAYER HAS BEEN AWARDED A FREEZONE, OR IS ATTEMPTING THE SIX ZONE SLAM.
5) UNLESS A PLAYER COMPLETES THE "SIX ZONE SLAM" THE ZONEBALL MUST BE THE LAST BALL TO BE POCKETED TO END THE FRAME. (SCORING 6 POINTS IF PLAYING A POINTS GAME), UNLESS A PLAYER FINDING THEM SELF TOO FAR BEHIND ON POINTS TO WIN, CONCEDES THE FRAME.
6) ONCE A PLAYER HAS ONLY THE ZONEBALL LEFT TO POCKET, THEY CAN ONLY DIRECTLY POCKET THE ZONEBALL PROVIDING IT RESTS INSIDE THE PLAYERS OWN COLOR ZONE. WHEN OUT OF ZONE, VIA A CROSS DOUBLE (CUE BALL OR ZONEBALL CONNECTS WITH A CUSHION FIRST), IN OFF AN OPPONENTS STARBALL, FROM ANY ZONE ON A FREEZONE.

THE BALLS

THE STARBALL. (VALUE 3 POINTS)

Whichever way you choose to play a game of Zoneball, victory will come quicker and emphatically for the player who places and pockets Starballs from inside their own color zones. Placing Starballs one the zones makes them opening available for pocketing and when playing for points, on zone Starballs increase their point values and, using the ZONEBALL, will increase the points value yet again. Games can be won by a quick clearance but, the player who bides their time and patiently waits to position as many STARBALLS on zone as they dare, and can then pocket as many on zone STARBALLS as possible in order to maximize point values or, set up the "SIX ZONE SLAM" position, can snatch an opponents potential victory away. But players must be brave, for racing for clearance of the ZONEBALL will be the quicker way to victory. Basically its all down to the players, risk, and the laws of the hexagon as to which plan of action to take.

7) STARBALLS ARE NEVER SHARED. ONCE A PLAYER HAS POCKETED A SINGLE COLOR STARBALL, THAT PLAYER CAN ONLY PLAY THAT COLOR TO THE END OF THE GAME.
8) A PLAYER IS PERMITTED TO POCKET A STARBALL FROM WHEREVER IT RESTS ON THE TABLE WHEN THE ZONEBALL HAS BEEN SELECTED,
9) A PLAYER MAY ONLY POCKET AN OFF ZONE STARBALL WITH THE CUE BALL WHEN; PLAYING FOR POINTS, VIA A CROSS DOUBLE, (CUE BALL OR STARBALL CONNECTS WITH A CUSHION FIRST), PLANT OR CANNON, IN OFF ANOTHER BALL OR, FROM ANY ZONE ON A FREEZONE.

THE USERBALL. (VALUE 1 POINT)

The Userball is for exactly as the name suggests, they are for both players to use in assisting in continuing the break, adding vital points to your score, as a block, or as a target. The Userball can be friend or foe, they will sometimes win or lose a player the game. Tactics, strategy and of course overall skill at making the most of the Userball is yet another factor to victory in the game of Zoneball.

10) A PLAYER IS PERMITTED TO POCKET A USERBALL FROM WHEREVER IT RESTS ON THE TABLE.
11) UNLESS A PLAYER COMPLETES THE "SIX ZONE SLAM" ALL USERBALLS MUST BE CLEARED FROM THE TABLE BEFORE A PLAYER CAN POCKET THE ZONEBALL TO END THE GAME.
12) A PLAYER IS PERMITTED TO PLAY OR POCKET A USERBAL WITH THE ZONEBALL PROVIDED THE ZONEBALL SITS IN THE PLAYERS OWN COLOR ZONE OR WITHIN THE BLUE ZONE, OR FROM A FREEZONE.
13) A PLAYER IS PERMITTED TO POCKET AS MANY USERBALLS THEY CHOOSE TO IN THE ORDER OF TACTICS OR MAINTAINING THE BREAK, OR SIMPLY TO GAIN VITAL EXTRA POINTS.

GENERAL RULES

THE BREAK

1) THE CUE BALL IS PLACED ANYWHERE WITHIN ONE OF THE OUTER BLUE ZONES TO BREAK OFF.
2) ALL STARBALLS POCKETED FROM THE BREAK SCORE BASE VALUE POINTS ONLY.
3) THE POCKETING OF THE ZONEBALL=GAME WIN. REGARDLESS OF ANY OTHER BALL BEING POCKETED, EXCLUDING THE CUE BALL.
4) THE POCKETING OF ONE COLOR STARBALL/S A PLAYER WHO POCKETS ONLY ONE COLOR STARBALL/S FROM THE BREAK IS THEREFORE PLAYS ONLY THAT COLOR STARBALL FOR THE REST OF THE GAME.
5) THE POCKETING OF ONE COLOR STARBALL/S+ USERBALL/S A PLAYER WHO POCKETS ONLY ONE COLOR STARBALL/S AND USERBALL/S FROM THE BREAK IS THEREFORE PLAYS ONLY THAT COLOR STARBALL FOR THE REST OF THE GAME.
6) THE POCKETING OF BOTH COLOR STARBALLS IN ALL GAMES OF ZONEBALL, A PLAYER WHO POCKETS A COMBINATION OF COLOR STARBALLS FROM THE BREAK, HAS AN OPEN TABLE UNTIL THAT PLAYER OR THE OTHER PLAYER POCKETS A SINGLE STARBALL.
7) USERBALLS A PLAYER WHO POCKETS ONLY USERBALL/S FROM THE BREAK, BUT DOES NOT POCKET ANY STARBALLS, HAS AN OPEN TABLE.
8) OPEN TABLE AN OPEN TABLE MEANS THAT BOTH COLOR STARBALLS ARE AVAILABLE TO BOTH PLAYERS, AND PROVIDED THE ZONEBALL RESTS INSIDE THE RELEVANT ZONE, CAN BE USED. UNTIL PLAYERS COLORS HAVE BEEN SELECTED, USERBALLS CANNOT BE PLAYED WITH THE ZONEBALL IF THE ZONEBALL RESTS INSIDE A STARBALL ZONE.

FOUL ON THE FIRST STARBALL POCKETED SHOULD A PLAYER MAKE A FOUL POCKETING THE FIRST STARBALL, THAT PLAYER GIVES AWAY 6 POINTS (FREEZONE). THE TABLE REMAINS OPEN. THE PLAYER WHO IS ALLOCATED THE SAME COLOR OF THE POCKETED STARBALL, CANNOT UNDERTAKE THE "SIX ZONE SLAM".

CROSSING THE ZONE DIVIDING LINE IN ALL GAMES OF ZONEBALL FOLLOWING ANY SHOT,

AND UNLESS A BALL IS POCKETED, AT LEAST ONE OF ANY OTHER BALL, EXCLUDING THE CUE BALL OR ZONEBALL IF SELECTED, MUST CROSS A ZONE DIVIDING LINE. THIS IS ABSOLUTE, AND FAILURE TO DO SO=6 POINTS AWAY (FREEZONE). ONLY WHEN THE CUE BALL OR ZONEBALL, IF SELECTED, IS DEEMED TO BE TOUCHING ANOTHER BALL, DOES IT MEAN THE PLAYER MUST PLAY AWAY FROM THE TOUCHED BALL, (AVOIDING A PUSH SHOT), WITHOUT ANY OTHER BALL NEEDING TO CROSS A ZONE DIVIDING LINE, BUT, WHICHEVER THE BALL SELECTED, BE IT THE CUE BALL OR ZONEBALL, MUST CROSS A ZONE DIVIDING LINE.

POCKETING AN OPPONENTS STARBALL A PLAYER WHO POCKETS ANY OF AN OPPONENTS STARBALL/S GIVES AWAY 24 STARBALL POINTS VALUE FOR EACH STARBALL POCKETED (FREEZONE). (SEE SIX ZONE SLAM FOUL!).

SNOOKERS A PLAYER IS AT LIBERTY TO OBTAIN EXTRA POINTS AND/OR GAIN TACTICAL ADVANTAGE'S FROM SNOOKERING AN OPPONENT.

CONCEDING A PLAYER IS AT LIBERTY TO CONCEDE A FRAME AT ANY TIME THEY CHOOSE TO.

THE FREEZONE FOLLOWING ANY FOUL BY A PLAYER, A FREEZONE IS AWARDED TO THE OTHER PLAYER, AND IF APPLICABLE, THE RELEVANT POINTS. THIS MEANS THAT THE AWARDED PLAYER CAN SELECT TO USE EITHER THE CUE BALL OR THE ZONEBALL FROM ANY WHERE IN ANY ZONE TO PLAY OR POCKET EITHER THEIR OWN STARBALLS OR USERBALLS. NEITHER THE CUE BALL OR THE ZONEBALL CAN BE MOVED BY HAND FROM THEIR CURRENT POSITIONS, AND THE VALUE OF ALL BALLS IS STILL DETERMINED BY THE POSITION THEY SIT IN THE ZONES. FOLLOWING THE POCKETING OF EITHER THE ZONEBALL OR CUE BALL OR BOTH, THE AWARDED PLAYER THEN PLACES THE BALL/S ON ANY AVAILABLE SPOVS OF THEIR CHOICE IN ANY ZONE, AND THEN SELECT TO USE EITHER THE CUE BALL OR ZONEBALL FOR THE FOLLOWING SHOT TO PLAY OR POCKET THEIR OWN STARBALLS OR USERBALLS.

FOUL BREAKS

1) NO BALLS ARE POCKETED OR LESS THAN TWO BALLS CONNECT WITH A CUSHION. =6 POINTS AWAY. RE-RACK. THE AWARDED PLAYER HAS OPTION TO BREAK.
2) THE POCKETING OF THE CUE BALL=(FREEZONE) 6 AWAY.
3) THE POCKETING OF THE CUE BALL+USERBALL/S=(FREEZONE) 6 AWAY.
4) THE POCKETING OF THE CUE BALL+STARBALL/S+USERBALL/S=(FREEZONE) 6 AWAY. ONLY THE CUE BALL IS BOUGHT BACK ONTO THE TABLE AND PLACED ON ANY AVAILABLE SPOT.

FOULS

1) THE POCKETING OF THE ZONEBALL (UNTIL PLAYERS FINAL BALL)=(FREEZONE) 6 AWAY.
2) THE POCKETING OF THE ZONEBALL AND USERBALL/S=(FREEZONE) 6 AWAY.
3) THE POCKETING OF THE ZONEBALL AND OWN COLOR STARBALL/S=(FREEZONE) 6 AWAY.
4) THE POCKETING OF THE CUE BALL=(FREEZONE) 6 AWAY.
5) THE POCKETING OF THE CUE BALL AND USERBALL/S=(FREEZONE) 6 AWAY.
6) THE POCKETING OF THE CUE BALL AND OWN COLOR STARBALL/S (FREEZONE) 6 AWAY.
7) THE POCKETING OF AN OPPONENTS STARBALL=(FREEZONE) 24 POINTS AWAY (SEE SIX ZONE SLAM, FOUL!).
8) CONNECTING WITH WRONG BALL=(FREEZONE) 6 AWAY.
9) TOUCHING ANY BALL WITH HAND, CLOTHING etc.=(FREEZONE) 6 AWAY.
10) FAILING TO CONNECT WITH A BALL=(FREEZONE) 6 AWAY.
11) REMOVING A PLAYERS STARBALL/S FROM A DECLARED SIX ZONE SLAM POSITION=LOST GAME.
12) ANY BALL FAILS TO CROSS A ZONE DIVIDING LINE (EXCLUDING CUE BALL USED)=(FREEZONE) 6 AWAY.
13) PLAYER DIRECTLY POCKETS OWN OFF ZONE STARBALL WITH THE CUE BALL (OTHER THAN FROM A FREEZONE OR PLAYING FOR POINTS) PLAYER LOSES THE GAME.

PUSH SHOTS PUSH SHOTS ARE STRICTLY FORBIDDEN AND DEEMED A FOUL. =(FREEZONE) 6 AWAY.

SIMULTANEOUSLY POCKETING THE CUE BALL AND ZONEBALL WHEN BOTH THE CUE BALL AND ZONEBALL ARE POCKETED, BOTH BALLS ARE BROUGHT BACK ONTO THE TABLE AND THE AWARDED PLAYER PLACES THE TWO BALLS ON ANY AVAILABLE SPOTS OF THEIR CHOICE. =(FREEZONE) 6 AWAY.

ZONEBALL AND CUE BALL THE CUE BALL CANNOT BE DIRECTLY PLAYED ONTO THE ZONEBALL UNTIL ALL USERBALLS ARE POCKETED AND IT 15 A PLAYERS FINAL BALL. =(FREEZONE) 6 AWAY.

CUE BALL AND ZONEBALL THE ZONEBALL CANNOT BE DIRECTLY PLAYED ONTO THE CUE BALL AT ANY TIME IN A GAME. =(FREEZONE) 6 AWAY.

OFF ZONE BALLS THAT ARE OUT OF ZONE ARE SCORED AT BASE VALUE ONLY, CANNOT BE DIRECTLY POCKETED OR ARE UNPLAYABLE.

SNOOKERED FOLLOWING A FOUL WHEN A PLAYER IS SNOOKERED FOLLOWING ANY FOUL SHOT, THAT PLAYER IS AWARDED THE RELEVANT POINTS (FREEZONE). THE AWARDED PLAYER IS THEN PERMITTED TO PLAY OR POCKET ANY OF AN OPPONENTS STARBALLS, OR TO USE THE OPPONENTS STARBALLS TO POCKET THEIR OWN STARBALLS OR USERBALLS, EVEN THE ZONEBALL SHOULD IT BE A PLAYERS LAST BALL, VIA A PLANT OR CANNON.

FREEZONE ON THE ZONEBALL WHEN A PLAYER HAS ONLY THE ZONEBALL REMAINING, AND THAT PLAYER HAS BEEN AWARDED A FREEZONE, THE AWARDED PLAYER MAY POCKET THE ZONEBALL FROM WHEREVER IT RESTS ON THE TABLE (ONLY FROM A FREEZONE).

DECLARING BALL VALUE IT IS IN THE INTEREST AND SPORTSMAN LIKE FOR A PLAYER TO DECLARE HOW MANY POINTS THEY ARE ATTEMPTING TO MAKE AT EACH SHOT, AS UNDECLARED BALLS SCORE BASE VALUE ONLY. AS FOR EXAMPLE, WHEN A PLAYER DECLARES, ATTEMPTS, AND SUCCESSFULLY POCKETS A STARBALL VALUED AT 24 POINTS NO DISPUTE CAN BE

MADE AGAINST THE SHOT AFTER, AS IT WAS DECLARED AND NOT DISPUTED BEFORE THE SHOT WAS TAKEN.

SPOT AVAILABILITY A PLAYER AWARDED A FREEZONE FOLLOWING THE POCKETING OF A CUE BALL AND OR ZONEBAH (ALSO SEE SIX ZONE SLAM), FINDS THAT NO SPOTS ARE AVAILABLE DUE TO THE EVENT THAT BALLS INFRINGE EVERY SPOT. THE AWARDED PLAYER THEN USES POINTS ON THE TABLE WHERE ALL THREE ZONES MEET IN PLACE OF THE SPOTS. THE BALL IS PLACED CENTRALLY ON THIS POINT. THIS IS THE ONLY INSTANCE THAT THE BALL IS DEEMED TO BE IN ALL THREE ZONES.

DRAWN GAME (POINTS GAMES ONLY) IF AT THE END OF THE GAME BOTH PLAYERS HAVE EQUAL POINTS, THEN THE GAME IS TO BE DECIDED BY BRINGING THE ZONEBALL BACK TO THE TABLE AND THE PLAYER WHO POCKETS THE ZONEBALL IN THE CORRECT WAY, WINS. THE PLAYER WHO COMMITS A FOUL AUTOMATICALLY LOSES THE GAME. TO DECIDE WHO WILL PLAY FIRST, BOTH PLAYERS SIMULTANEOUSLY PLAY THE CUE BALL AND ZONEBALL ACROSS THE WIDTH OF THE TABLE CONNECTING WITH THE OPPOSITE CUSHION, (ONE PLAYER USES THE CUE BALL THE OTHER THE ZONEBALL) THE PLAYER WHO'S BALL STOPS ON OR NEAREST TO THE CUSHION HAS THE OPTION TO PLAY, OR MAKE THE OTHER PLAYER GO FIRST. THE ZONEBALL IS THEN PLACED ON A SPOT IN ANY ONE OF THE OUTER BLUE ZONES AND THE CUE BALL IS PLACED ANYWHERE WITHIN THE BLUE ZONE DIRECTLY OPPOSITE.

POCKETING THE ZONEBALL BOTH PLAYERS HAVE ONLY THE ZONEBALL LEFT TO POCKET AND CAN ONLY DIRECTLY POCKET THE ZONEBALL PROVIDING IT RESTS INSIDE A PLAYERS OWN COLOR ZONE. WHEN OUT OF ZONE, VIA A CROSS DOUBLE (CUE BALL OR ZONEBALL CONNECTS WITH A CUSHION FIRST).

SIX ZONE SLAM

THE SIX ZONE SLAM ONE OF THE MORE UNIQUE AND WITHOUT DOUBT EXCITING WAYS TO WIN A GAME OF ZONEBALL IS THE "SIX ZONE SLAM" THIS CONSISTS OF A PLAYER POCKETING ALL SIX STARBALLS FROM INSIDE THEIR OWN COLOR ZONES AT ONE VISIT. THE STARBALLS CAN BE IN ANY COMBINATION OF GROUPS WITHIN THEIR OWN 3 ZONES. THE PLAYER IS PERMITTED TO USE A COMBINATION OF USERBALLS AS WELL AS THE ZONEBALL, WHICH IS NOW AVAILABLE TO THE PLAYER FROM INSIDE ANY ZONE ON THE TABLE FOR THE DURATION OF THE PLAYERS VISIT. IT IS THE LAST STARBALL THAT IS THE CRITICAL BALL, ONCE POCKETED THE GAME IS WON, EVEN THOUGH THE OTHER PLAYER MAY HAVE A HIGHER POINTS TOTAL, REGARDLESS THAT THE ZONEBALL REMAINS ON THE TABLE, REGARDLESS THAT USERBALLS MAY STILL REMAIN ON THE TABLE, THE POCKETING OF THE SIXTH STARBALL FROM OFF ITS OWN ZONE IS AN UNARGUABLE EMPHATIC VICTORY HOWEVER, ANY FOUL, AND INCLUDING SIMULTANEOUSLY POCKETING EITHER THE CUE BALL OR ZONEBALL WITH THE LAST STARBALL GIVES AWAY A FREEZONE AND IF APPLICABLE THE RELEVANT POINTS, AND THE PLAYER MUST POCKET ANY REMAINING USERBALLS AND THE ZONEBALL TO WIN THE GAME. WHEN ATTEMPTING TO COMPLETE THE "SIX ZONE SLAM", A PLAYER MAY HAVE TO CONNECT WITH THEIR REMAINING ON ZONE STARBALLS, THUS MOVING THEM FROM INSIDE THEIR ZONE BUT, PROVIDED THE STARBALL/S COME BACK TO REST INSIDE THEIR CORRESPONDING COLOR ZONES THEN THE PLAYER IS ALLOWED TO CONTINUE THE SIX ZONE SLAM, FOR, IF ANY OF THEIR STARBALLS FAIL TO COME BACK AND REST INSIDE THE CORRESPONDING COLOR ZONES, THEN THE PLAYER IS ALLOWED TO CONTINUE THE VISIT BUT, THE SLAM FINISH IS NO LONGER AVAILABLE AND THE ZONEBALL CAN NO LONGER BE SELECTED FROM ANY ZONE, AND THE PLAYER MUST NOW CLEAR THE USERBALLS AND POCKET THE ZONEBALL CORRECTLY TO WIN. WHEN ATTEMPTING THE SIX ZONE SLAM IN A POINTS GAME, AND A PLAYER FAILS TO POCKET A BALL OR MAKES A FOUL, THEN ALL BALLS POCKETED UP TO THAT POINT SCORE THEIR RELEVANT VALUES.

THE BREAK WHEN A PLAYER POCKETS ONE OR MORE OF THE SAME COLOR STARBALL FROM THE BREAK, THAT PLAYER DOES NOT HAVE THE SIX ZONE SLAM OPTION AVILABLE FOR THAT GAME, AS THE PLAYER IS AUTOMATICALLY THAT COLOR FOR THE REST OF THE GAME. WHEN A PLAYER POCKETS A COMBINATION OF COLOR STARBALLS FROM THE BREAK, NEITHER PLAYER HAS THE SIX ZONE SLAM OPTION AVAILABLE FOR THAT GAME.

FOUL! WHEN A PLAYER HAS SIX STARBALLS AND AN OPPONENT FOULS BY POCKETING ONE OR MORE OF THAT PLAYERS SIX STARBALLS, THE PLAYER IS AWARDED A FREEZONE AND IF APPLICABLE, 24 POINTS PER STARBALL POCKETED. THE AWARDED PLAYER IS STILL PERMITTED A "SLAM" CLEARANCE TO WIN THE GAME WITH HOWEVER MANY STARBALLS THAT PLAYER HAS REMAINING. WHEN A PLAYER HAS SET UP A SLAM POSITION AND AN OPPONENT CONNECTS AND CANNONS A NUMBER OF THAT PLAYERS IN ZONE STARBALLS OUT OF ZONE, THE SLAM PLAYER IS AWARDED 6 POINTS AND A FREEZONE. THE AWARDED PLAYER IS ALSO PERMITTED TO SELECT AND REPOSITION BY HAND, UP TO THE EQUAL NUMBER OF THEIR REMOVED STARBALUS OF THEIR CHOICE TO ANY AVAILABLE SPOT/S, ANY 3 ZONE MEETING POINT/S (AS ILLUSTRATED ON SPOT AVAILABILITY) OR A COMBINATION OF BOTH.

DECLARING WHEN A PLAYER HAS A SIX ZONE SLAM POSITION SET UP AND IT IS POSSIBLE THAT IN SOME GAMES AN OPPONENT MAY, BY WAY OF CANNONS AND REBOUNDS, SET THE SIX ZONE SLAM UP FOR THE PLAYER. THEN THE PLAYER MUST DECLARE IT BEFORE THE OPPONENT IS AT THE TABLE OR HAS PLAYED THEIR FOLLOWING SHOT. FOR SHOULD ANY SET UP STARBALLS THEN BE REMOVED FROM ZONE BY THE OPPONENT, THE PLAYER CANNOT DISPUTE IT, OR CLAIM A FREEZONE AFTER THE OPPONENT HAS TAKEN THEIR FOLLOWING SHOT.

PLANTS AND CANNONS

PLANTS AND CANNONS CAN PLAY A VERY BIG PART IN ZONEBALL AND, THE PLAYER THAT SEEKS

THEM AND APPLIES THEM WILL SUCCEED IN ZONEBALL. MOST PLANTS AND CANNONS THAT ARE PERMISSIBLE ARE APPARENT. THE FOLLOWING EXAMPLES SHOW A SELECTION OF PLANTS, AND ARE GUIDES IN ASSISTING AS TO WHAT IS PERMISSIBLE IN A GAME OF ZONEBALL. ALL EXAMPLES SHOW THE ZONEBALL BEING SELECTED AND ALL THE PLANTS AND CANNONS ARE PERMISSIBLE WITH THE CUE BALL. EXAMPLES 1 & 2 ARE ONLY PERMISSIBLE WHEN THE TABLE 15 OPEN. SHOULD BOTH COLORS BE POCKETED THE TABLE WOULD REMAJN OPEN. WHEN PLAYING ZONEBALL WITH POINTS, IT IS IN THE INTEREST AND SPORTSMAN LIKE IF PLAYERS DECLARE THE POINTS VALUES THEY ARE ATTEMPTING TO GAIN BEFORE PLAYING THE SHOT, AS UNDECLARED BALLS WILL BE SCORED AT BASE VALUE ONLY, REGARDLESS OF THEIR PREVIOUS POSITION.

THE ZONE GAUGE

UNDER CIRCUMSTANCES WHERE NO REFEREE IS PRESENT, AND A BALL IS CLOSE TO, OR APPEARS TO BE ON A ZONE DIVIDING LINE, AND NO AGREEMENT CAN BE MET BY BOTH PLAYERS REGARDING THE BALLS EXACT POSITION, THEN THE GAUGE IS USED TO VERIFY ACCURATELY WHAT ZONE THE DISPUTED BALL IS IN.

UNDER SUCH CIRCUMSTANCES IT IS THE PLAYER WHO WISHES TO PLAY THE DISPUTED BALL THAT MUST USE A GAUGE OF SOME TYPE. THE BALL CAN ONLY BE APPROACHED FROM THE BALLS DISPUTED COLOR ZONE, SHOULD THE BALL THEN BE TOUCHED BY THE GAUGE IT WILL BE DEEMED A PUSH AND THEREFORE THE BALL IS CONSIDERED OUT OF ZONE. THEREFORE THE BALL IS EITHER UNPLAYABLE, VALUED AT THE RELEVANT OFF ZONE SCORE ONLY, OR IT CANNOT BE DIRECTLY POCKETED. TOUCHING THE BALL WITH THE GAUGE DOES NOT CONSTITUTE A FOUL, ONLY A PUSH, AND PLAYERS SHOULD APPROACH SUCH CIRCUMSTANCES IN A SPORTSMAN LIKE FASHION.

THE GAUGE MUST BE PLACED UP TO THE BALL FROM THE CORRESPONDING COLOR ZONE ONLY. SHOULD THIS PROVE IMPOSSIBLE, DUE TO THE OBSTRUCTION OF OTHER BALLS, AND OR CUSHIONS BEING TO CLOSE, PREVENTING THE GAUGE BEING CORRECTLY PLACED UP TO THE BALL, THEN THE BALL IS, UNPLAYABLE, VALUED AT THE RELEVANT OFF ZONE SCORE ONLY, OR IT CANNOT BE DIRECTLY POCKETED.

ZONEBALL GAMES

POINTS ZONERBALL IT SHOULD BE NOTED THAT POINTS MAY OR MAY NOT BE TRACKED DURING THE PLAY OF ZONEBALL PER THE DESIRES OF THE USER. ASIDE FROM ONE REALLY SIGNIFICANT RULE CHANGE PLAYING ZONEBALL FOR POINTS MEANS PLAYERS CAN POCKET OFF ZONE STARBALLS WITH THE CUE BALL BUT THE STARBALL VALUE IS ONLY A MERE 3 POINTS. HERE ARE THE RELEVANT BALL VALUES:

POCKETING AN OFF ZONE STARBALL WITH THE CUE BALL=3 POINTS

POCKETING AN ON ZONE STARBALL WITH THE CUE BALL=6 POINTS

POCKETING AN ON ZONE STARBALL WITH AN OFF ZONE ZONEBALL=6 POINTS

POCKETING AN ON ZONE STARBALL WITH AN ON ZONE ZONEBALL=24 POINTS

TRAP ZONE

IF THERE IS ONE GAME IN THE SERIES OF ZONEBALL GAMES THAT EPITOMISES THE VERY ESSENCE OF ZONEBALL, THEN TRAP ZONE IS THAT GAME, THIS GAME UTILISES THE 13 GOLDEN RULES BUT, THERE ARE 2 SIGNIFICANT RULES THAT PLAYERS HAVE TO ADOPT INTO THE GAME THAT IN TURN CREATES A GAME PLAY THAT MEANS PLAYERS ARE REQUIRED TO USE A HIGHER LEVEL OF STRATEGIC PLANNING AND RISK, NOT TO MENTION SPORTSMANSHIP. THE CUE BALL IN THIS GAME IS PRIMARILY FOR MANOEUVRING AND THE ZONEBALL IT SELF WILL BE HIGHLY SOUGHT BY BOTH PLAYERS. THE CLEVER PLAYER WILL TRY THEIR UPMOST TO KEEP CONTROL OF IT, OR AT LEAST PREVENT THE OPPONENT FROM USING IT AND USERBALLS WILL HAVE TO BE CLOSELY MONITORED AND PLAYED WISELY. THE PROSPECT OF ACHIEVING A SIX ZONE SLAM IS ALSO MUCH HIGHER AND THIS GAME LENDS IT SELF INTO TEMPTING PLAYERS TRYING FOR THAT PRESTIGIOUS SLAM FINISH.

TRAP ZONE RULES

1) PLAYERS CANNOT POCKET ANY STARBALLS DIRECTLY WITH CUE BALL UNTIL THE PLAYERS HAVE ALL OF THEIR REMAINING STARBALLS RESTING INSIDE THEIR OWN COLOR ZONES.
2) PLAYERS CANNOT REMOVE ANY OF AN OPPONENTS ON ZONE STARBALLS FROM INSIDE THEIR OPPONENTS ZONES AS THIS WILL RESULT IN GIVING AWAY A FREEZONE. AN AWARDED PLAYER MAY REPLACE ANY OR THE EQUIVALENT NUMBER OF OUT OF ZONE STARBALLS OF THEIR CHOICE TO ANY AVAILABLE SPOTS, OR ALTERNATIVELY PLACE THE STARBALLS ON THE POINTS OF THE ZONE STAR WHERE ALL THREE ZONES MEET.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A billiard type game comprising, in combination:

a table including a planar top plate having a top face, a bottom face and a periphery with a hexagonal configuration, the periphery of the top plate having a peripheral lip integrally coupled thereto and extending upwardly therefrom with a plurality of elastomeric bumpers mounted on an interior surface thereof, the table further including a vertically oriented bore formed in each corner thereof, the table further including a base with a hexagonal horizontal cross-section along a height thereof mounted to the bottom face of the top plate for supporting the same and a plurality of tubular nets each having a closed bottom and an open top mounted to the bottom face of the top plate about an associated one of the bores;

said top face of the top plate of the table having a felt lining divided into a plurality of zones defined by three colors, the sections including six triangular neutral zones each with a first color and a side edge situated along one side of the peripheral lip of the table, a central hexagonal neutral zone with the first color, and six player zones of which three have a second color and three have a third color, the player zones each having a frusto-diamond shaped configuration and further situated in an alternating fashion;

twelve star balls including six star balls of the second color and six star balls of the third color;

six user balls of a fourth color;

a single cue ball;

a single zone ball of a fifth color;

a pair of cue sticks; and a rack with a hexagonal configuration, the rack adapted to be removably situated on a pair of horizontally oriented, parallel pegs mounted on a side face of the base of the table.

2. A billiard type game comprising:

a table having a top plate with a hexagonal configuration and a vertically oriented pocket formed in each corner thereof;

a plurality of balls;

a rack with a hexagonal configuration;

wherein the top plate has a top face, and a plurality of zones cover substantially the entire top face of the top plate, and wherein the zones include a plurality of neutral zones and a plurality of player zones.

3. A billiard type game as set forth in claim 2 wherein the balls include twelve star balls, six user balls, a single cue ball, a single zone ball.

4. A billiard type game as set forth in claim 2 wherein the rack is removably situated on a pair of horizontally oriented, parallel pegs mounted on the table.

5. A billiard type game as set forth in claim 2 wherein a top face of the top plate of the table has a felt lining.

6. A billiard type game as set forth in claim 2 wherein the neutral zones have a first color and the player zones each have one of two different colors.

7. A billiard type game as set forth in claim 2 wherein the neutral zones surround the player zones.

8. A billiard type game as set forth in claim 2 wherein the neutral zones include at least one neutral zone situated between the player zones.

9. A method of playing a billiard type game comprising the steps of:

providing a table including a planar top plate having a top face, a bottom face and a periphery with a hexagonal configuration, the periphery of the top plate having a peripheral lip integrally coupled thereto and extending upwardly therefrom with a plurality of elastomeric bumpers mounted on an interior surface thereof, the table further including a vertically oriented bore formed in each corner thereof, the table further including a base with a hexagonal horizontal cross-section along a height thereof mounted to the bottom face of the top plate for supporting the same and a plurality of tubular nets each having a closed bottom and an open top mounted to the bottom face of the top plate about an associated one of the bores, said top face of the top plate of the table having a felt lining divided into a plurality of zones defined by three colors, the sections including six triangular neutral zones each with a first color and a side edge situated along one side of the peripheral lip of the table, a central hexagonal neutral zone with the first color, and six player zones of which three have a second color and three have a third color, the player zones each having a frusto-diamond shaped configuration and further situated in an alternating fashion;

providing twelve star balls including six star balls of the second color and six star balls of the third color;

providing six user balls of a fourth color;

providing a single cue ball;

providing a single zone ball of a fifth color;

providing a pair of cue sticks;

providing a rack with a hexagonal configuration, the rack adapted to be removably situated on a pair of horizontally oriented, parallel pegs mounted on a side face of the base of the table; and racking the twelve star balls and user balls in the central hexagonal neutral zone with the rack;

placing the cue ball in one of the triangular neutral zones; and striking the cue ball against the racked balls.

* * * * *